US009888749B1

(12) United States Patent
Kawakami

(10) Patent No.: US 9,888,749 B1
(45) Date of Patent: Feb. 13, 2018

(54) ACCESSORY

(71) Applicant: Yasuhiro Kawakami, Fuefuki (JP)

(72) Inventor: Yasuhiro Kawakami, Fuefuki (JP)

(73) Assignee: Top Jewelry Co., Ltd., Kofu, Yanamashi (JP)

( * ) Notice: Subject to any disclaimer, the term of this patent is extended or adjusted under 35 U.S.C. 154(b) by 0 days.

(21) Appl. No.: 15/453,341

(22) Filed: Mar. 8, 2017

(51) Int. Cl.

| | |
|---|---|
| ***A44C 17/00*** | (2006.01) |
| ***A44C 17/02*** | (2006.01) |
| ***A44C 25/00*** | (2006.01) |
| ***A44C 1/00*** | (2006.01) |
| ***A44C 5/00*** | (2006.01) |
| ***A44C 7/00*** | (2006.01) |

(52) U.S. Cl.
CPC ..... *A44C 17/0258* (2013.01); *A44C 1/00* (2013.01); *A44C 5/00* (2013.01); *A44C 7/00* (2013.01); *A44C 25/001* (2013.01)

(58) Field of Classification Search
CPC ..... A44C 13/00; A44C 17/02; A44C 17/0208; A44C 17/0258; A44C 17/0275; A44C 17/0283; A44C 25/001; A44C 25/007
See application file for complete search history.

(56) References Cited

U.S. PATENT DOCUMENTS

| | | | | |
|---|---|---|---|---|
| 378,043 | A * | 2/1888 | Edge | A44C 7/00 63/13 |
| 9,167,872 | B2 | 10/2015 | Dobashi | |
| 2003/0110797 | A1* | 6/2003 | Kimura | A44C 17/0275 63/31 |
| 2013/0239613 | A1* | 9/2013 | Shah | A44C 17/0275 63/27 |

FOREIGN PATENT DOCUMENTS

| | | |
|---|---|---|
| JP | 3116604 U | 11/2005 |
| JP | 2013-226462 A | 11/2013 |

* cited by examiner

*Primary Examiner* — Jack W Lavinder
(74) *Attorney, Agent, or Firm* — Richard M. Goldberg

(57) ABSTRACT

An accessory includes an accessory frame body having a pair of bearing recesses positioned at a prescribed spacing, and a decorative member held in a swingable state across the region between the bearing recesses of the accessory frame body, the decorative member extending in the horizontal direction after curving upward at a prescribed location, and having formed at the extended ends, protruding to both sides, swinging arm sections with downwardly-pointing pivoting support shafts, the pivoting support shafts of the swinging arm sections engaging with the bearing recesses formed in the accessory frame body, thereby attaching the decorative member to the accessory frame body in a freely swingable state.

9 Claims, 27 Drawing Sheets

【Fig. 1】
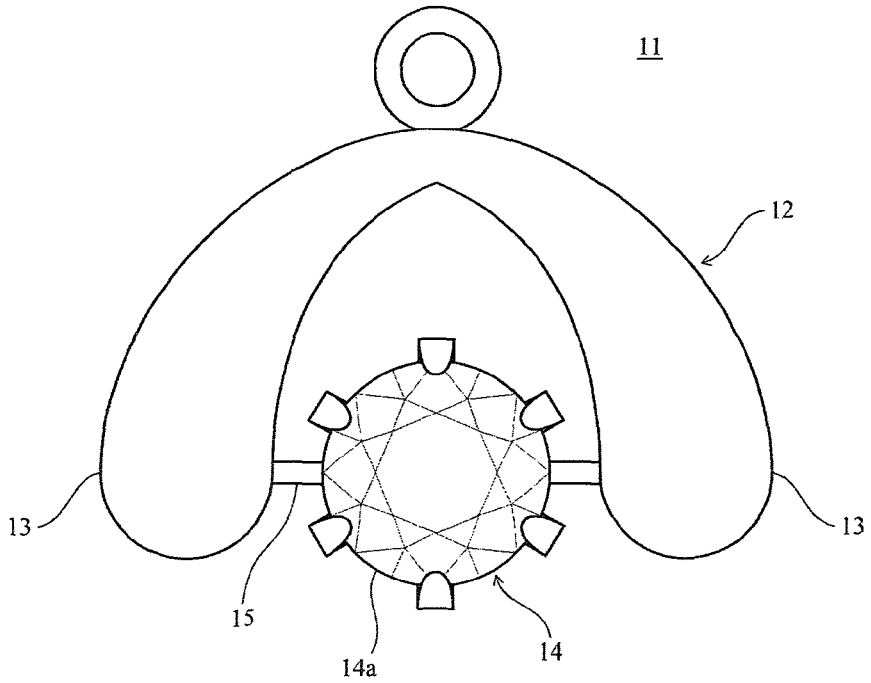
【Fig. 2】
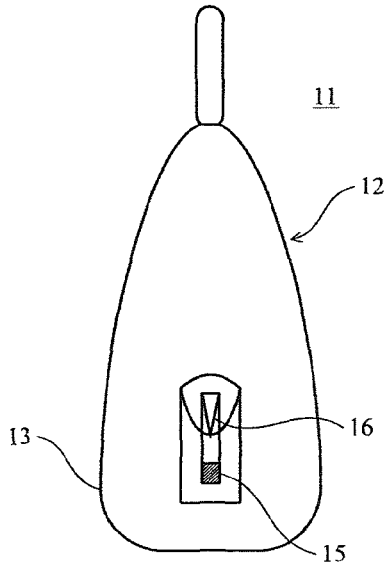

【Fig. 3】
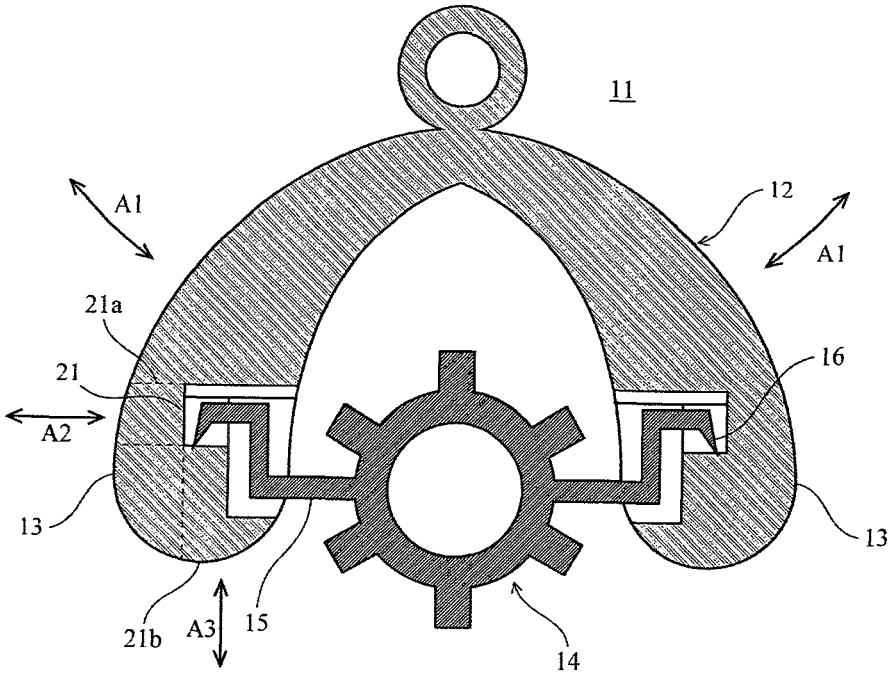

【Fig. 4】
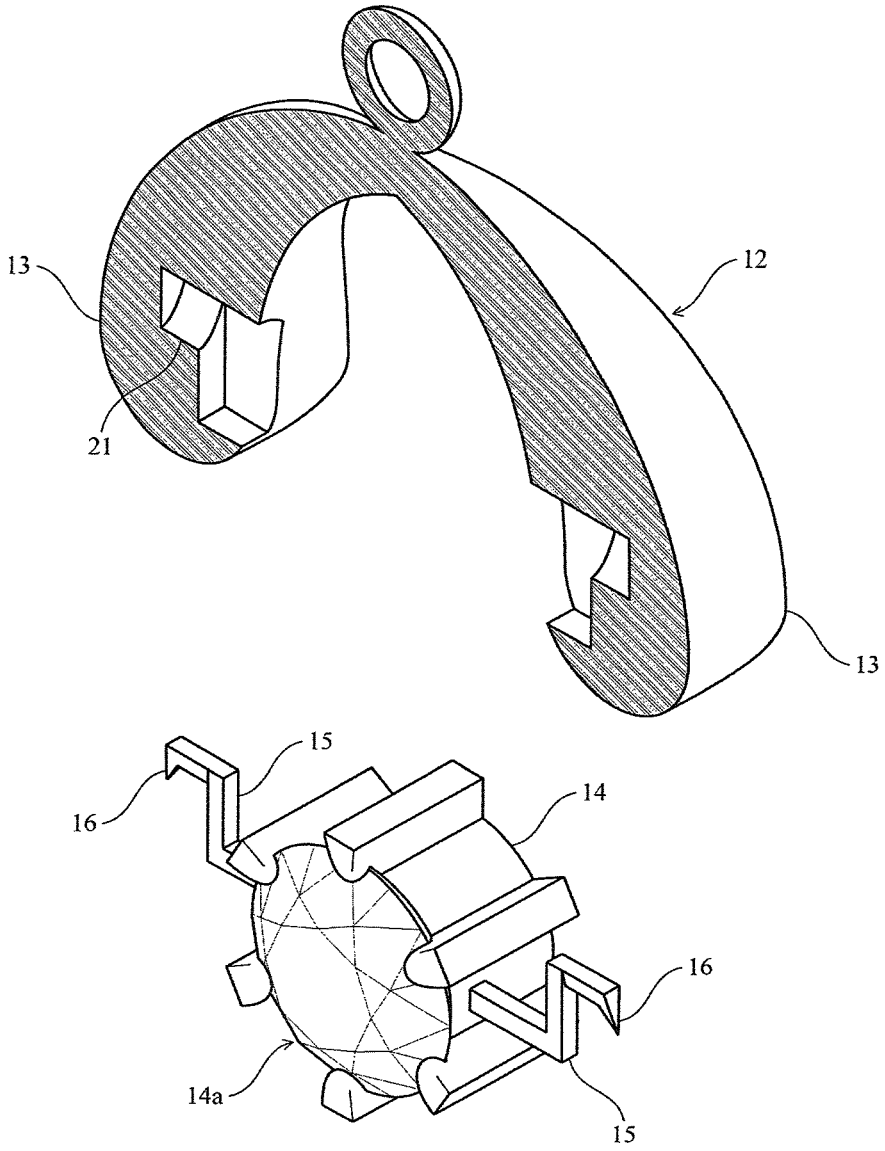

【Fig. 5】
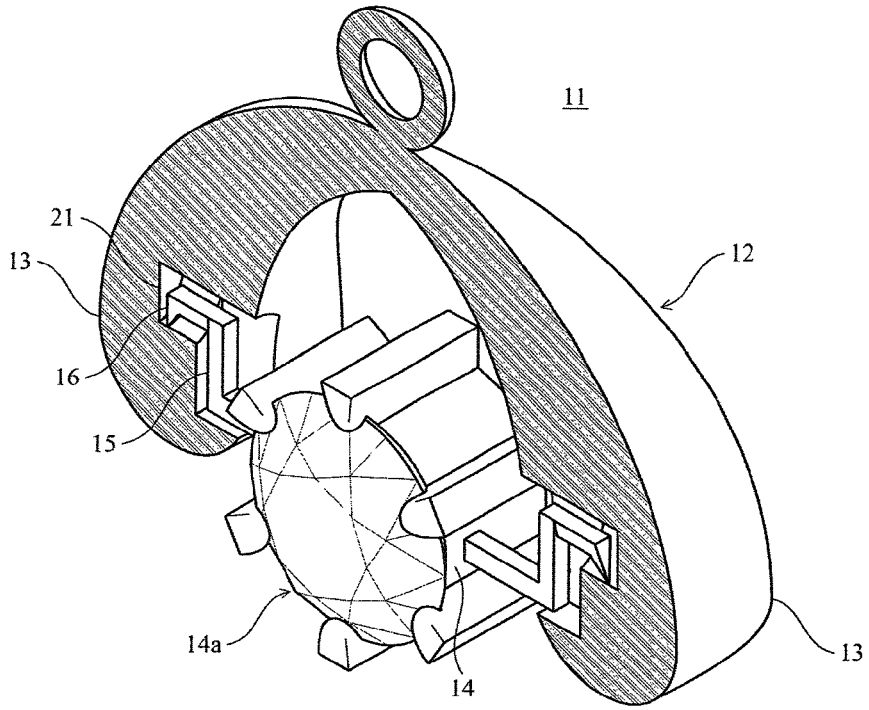
【Fig. 6】
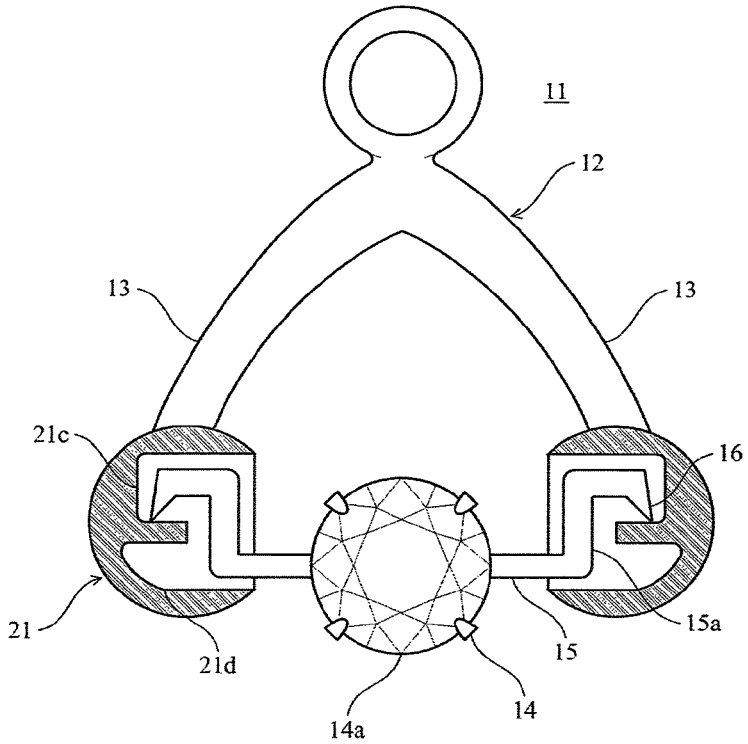

【Fig. 7】
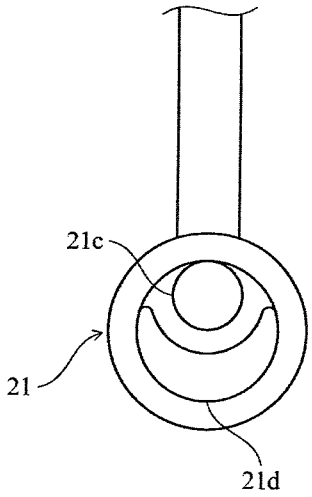
【Fig. 8】
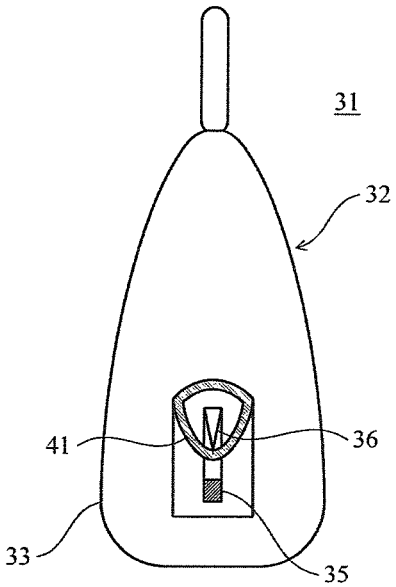

【Fig. 9】
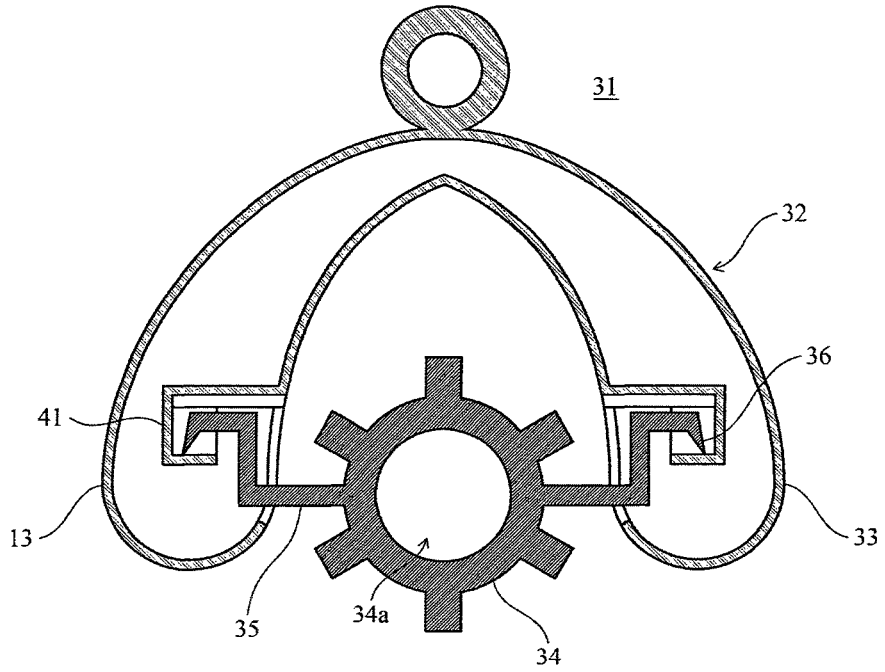
【Fig. 10】
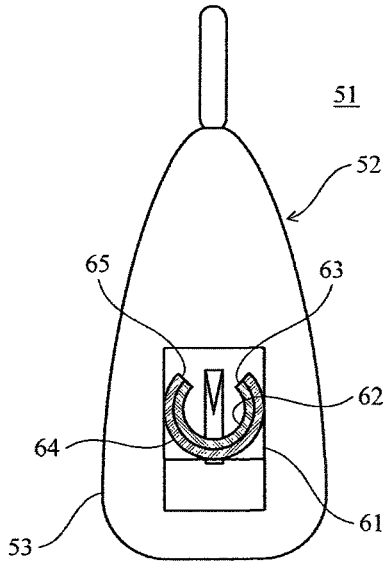

【Fig. 11】
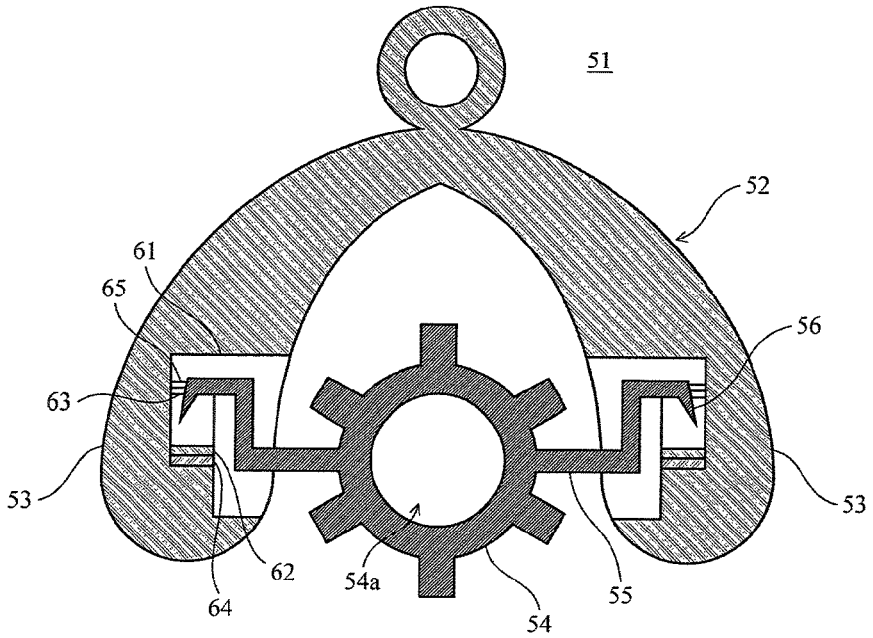
【Fig. 12】
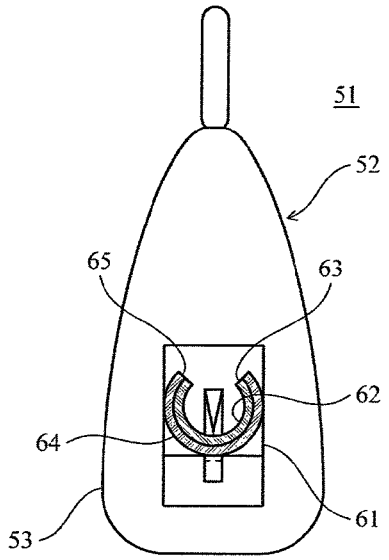

【Fig. 13】
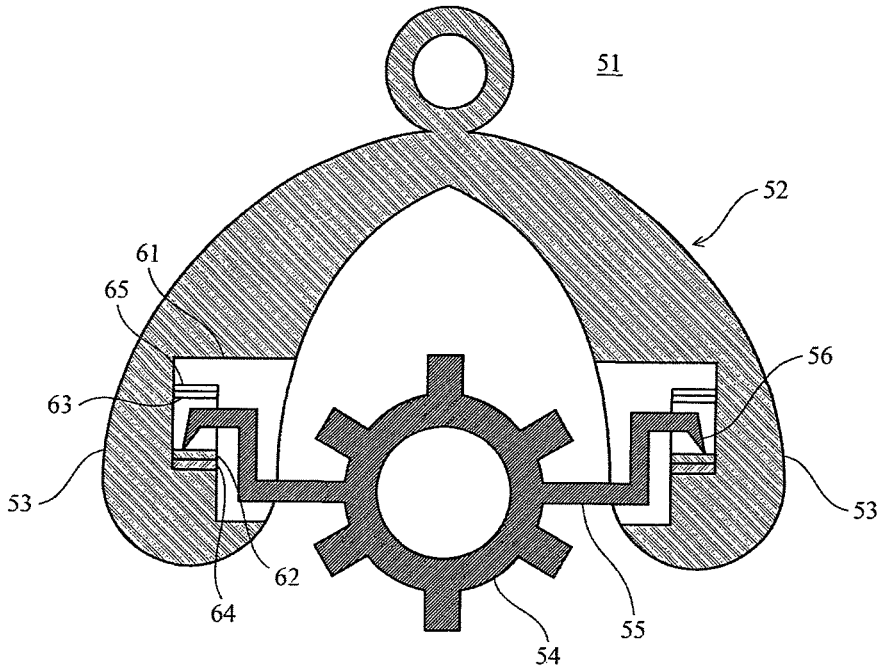
【Fig. 14】
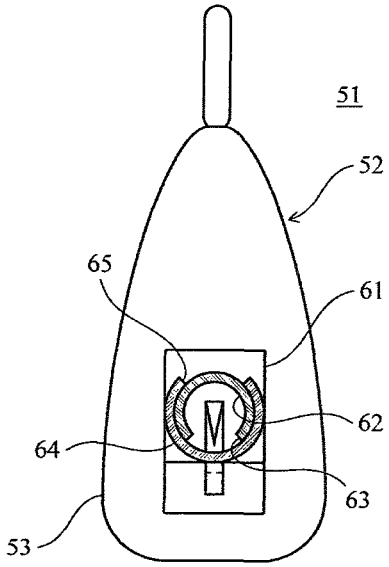

【Fig. 15】
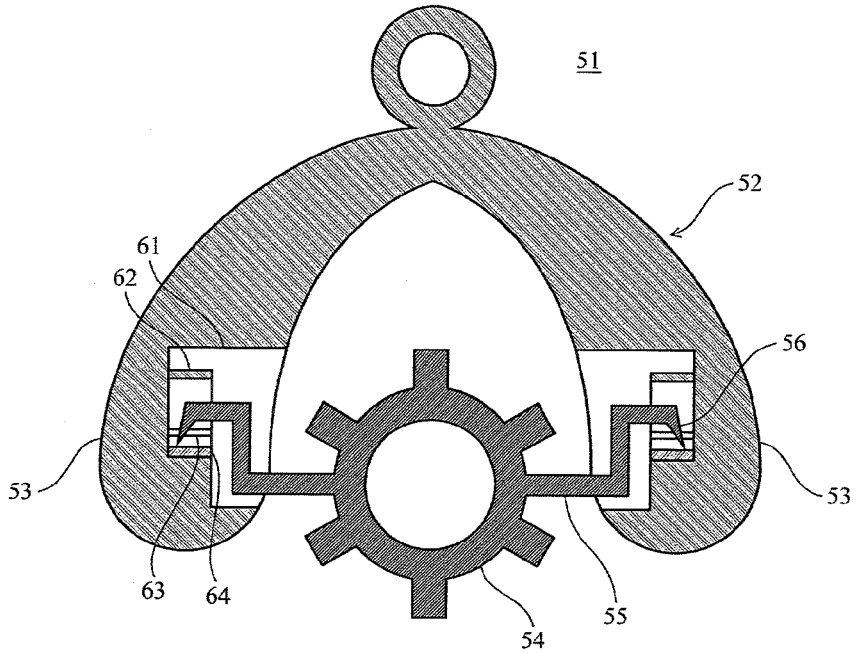
【Fig. 16】
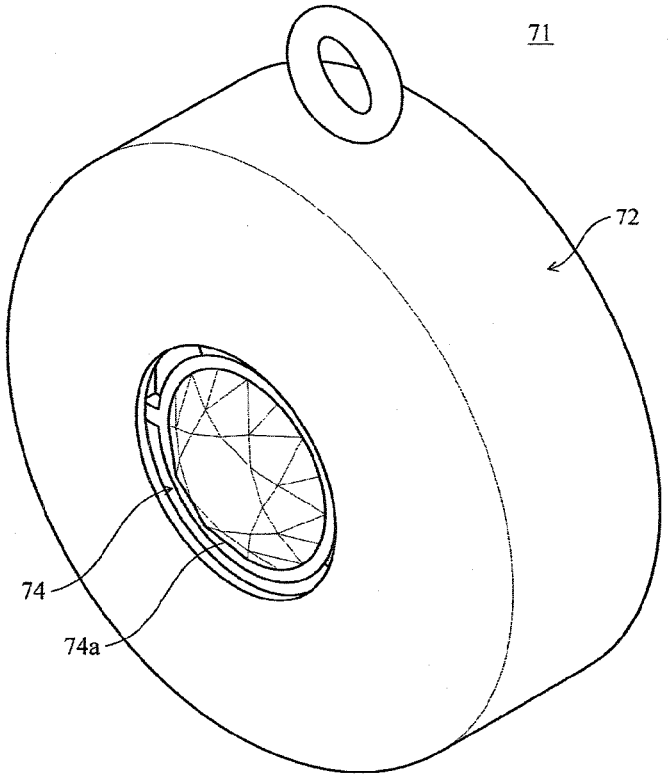

【Fig. 17】
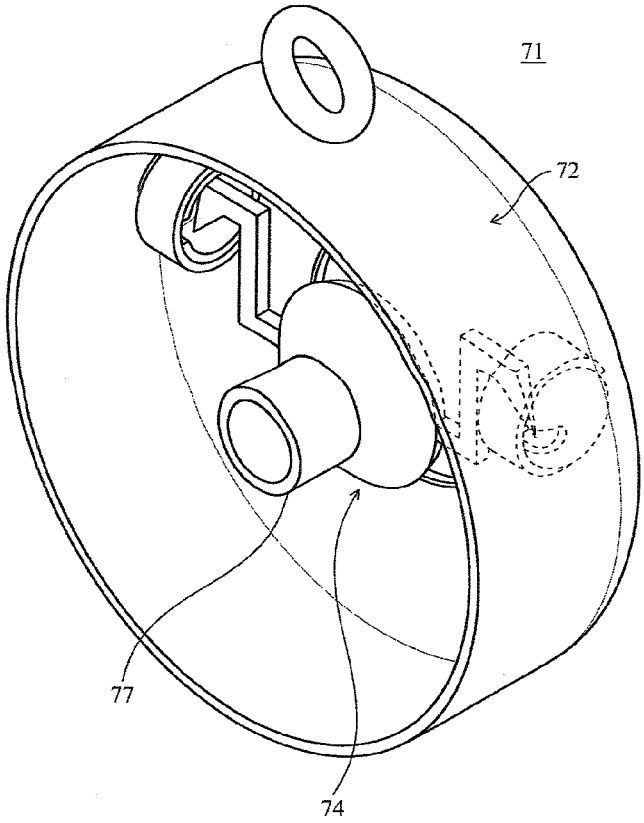
【Fig. 18】
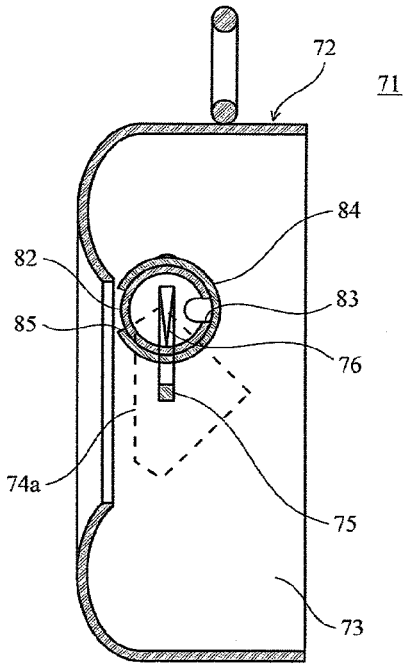

【Fig. 19】
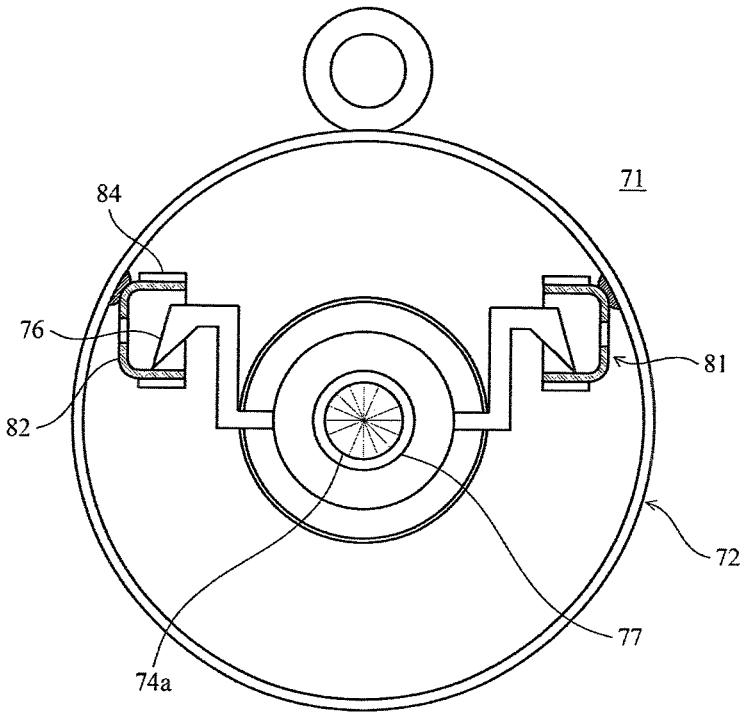
【Fig. 20】
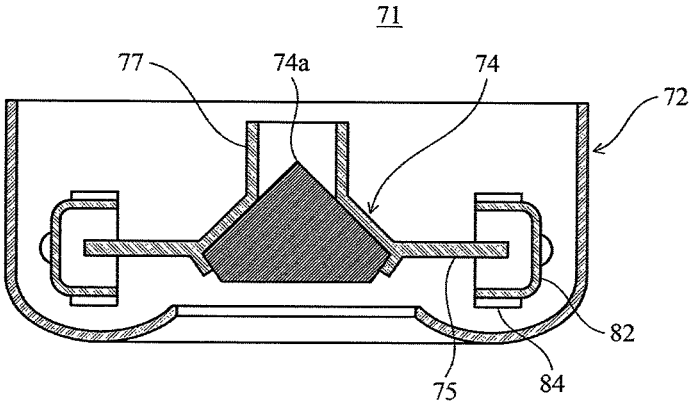

【Fig. 21】
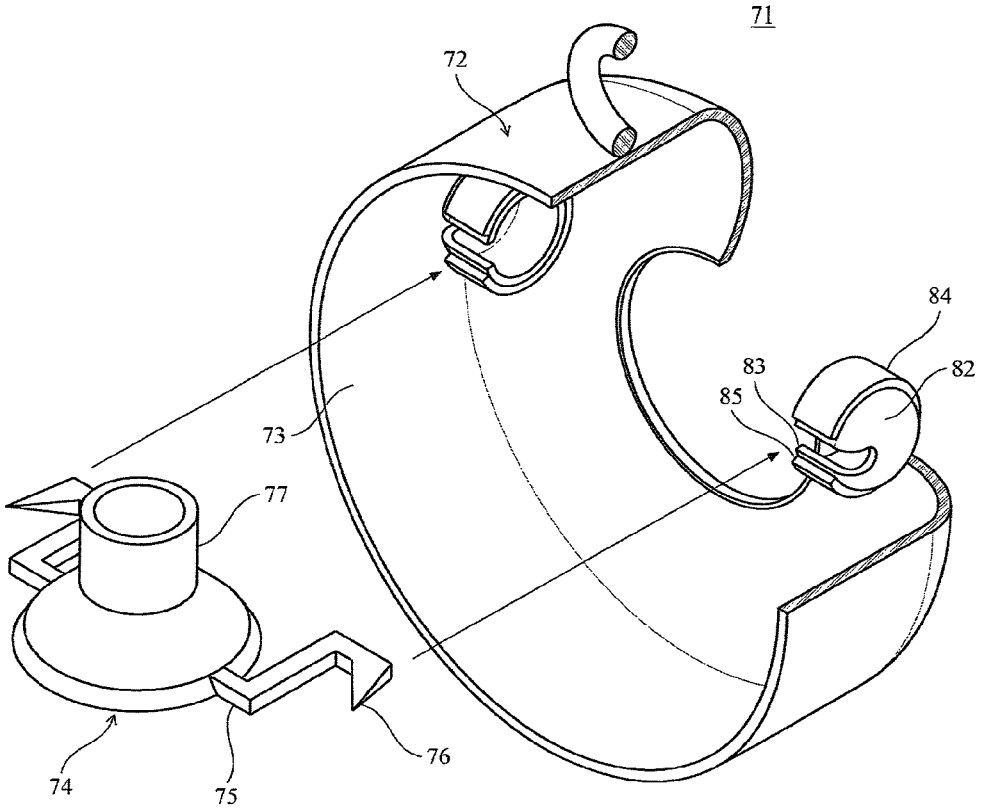

【Fig. 22】
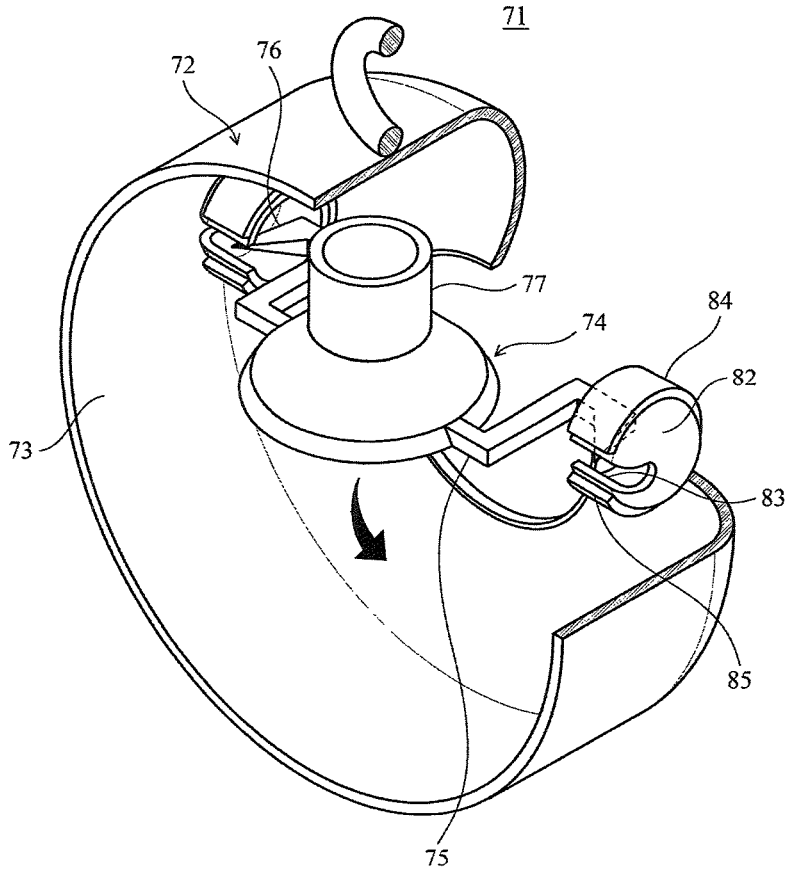

【Fig. 23】
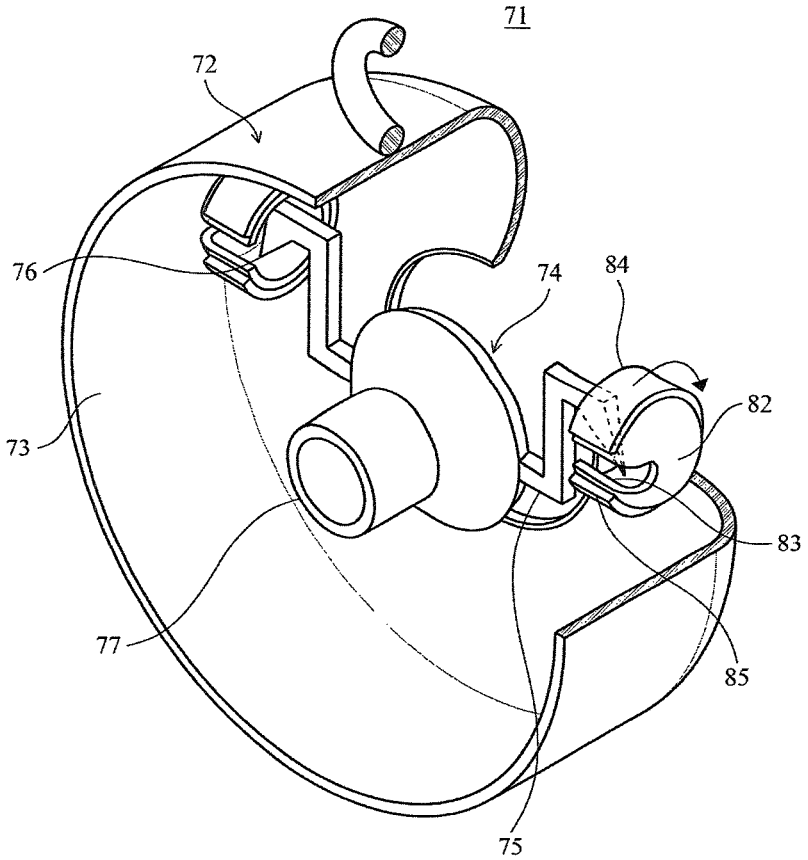

【Fig. 24】
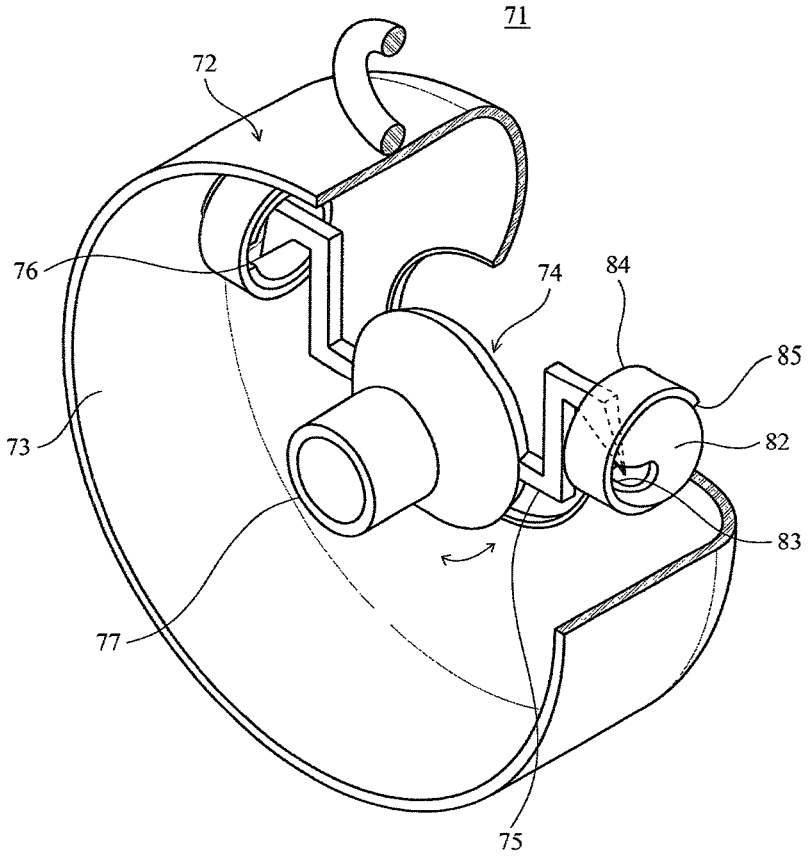
【Fig. 25】
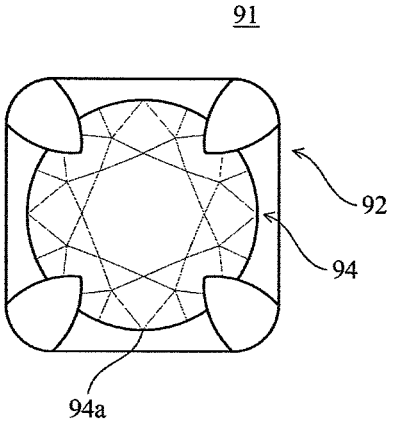

【Fig. 26】
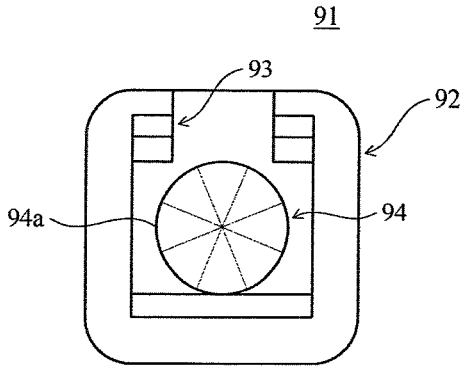
【Fig. 27】
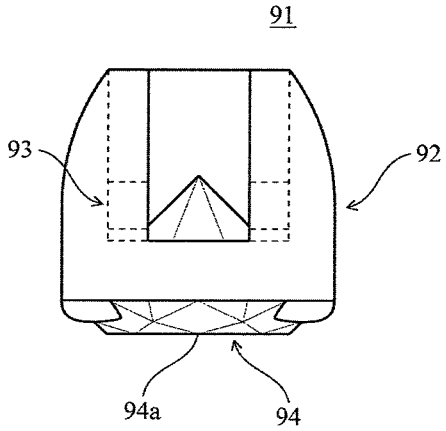
【Fig. 28】
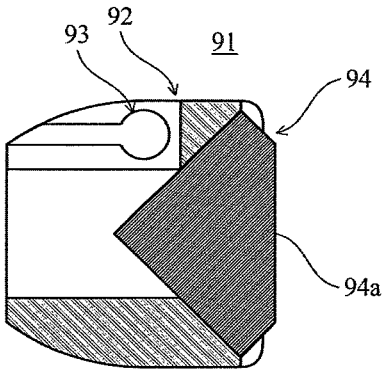

【Fig. 29】
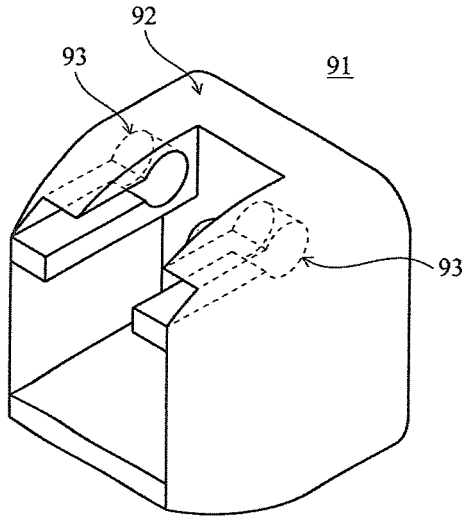
【Fig. 30】
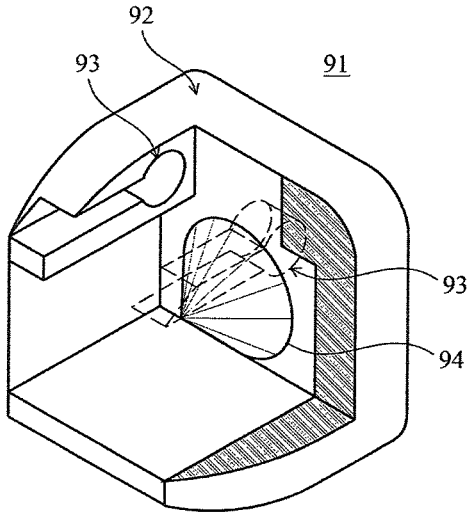

【Fig. 31】
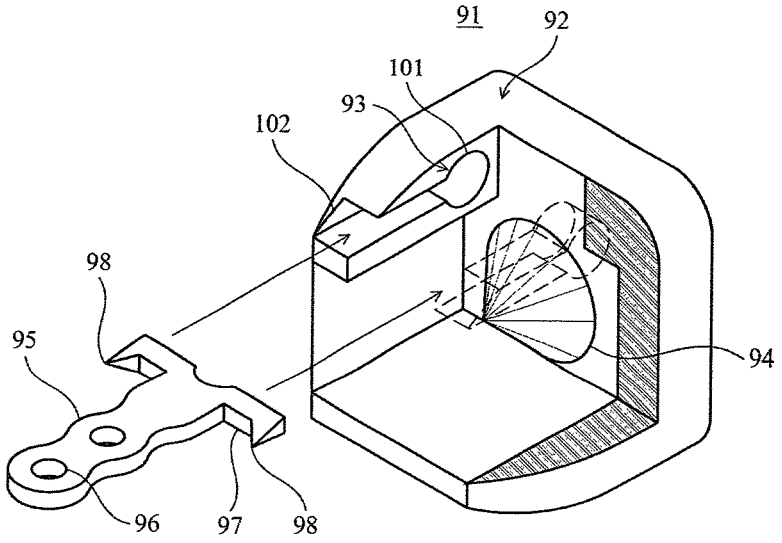
【Fig. 32】
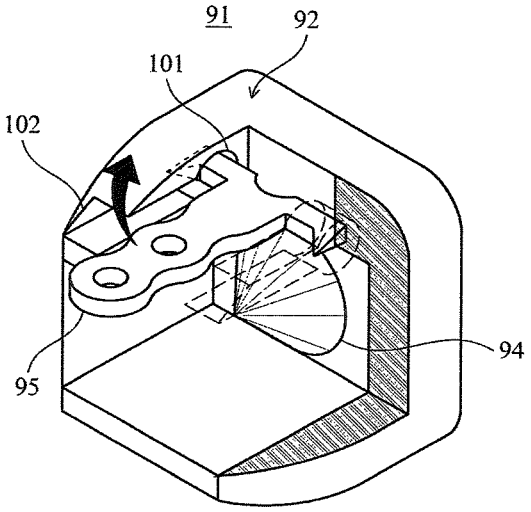

【Fig. 33】
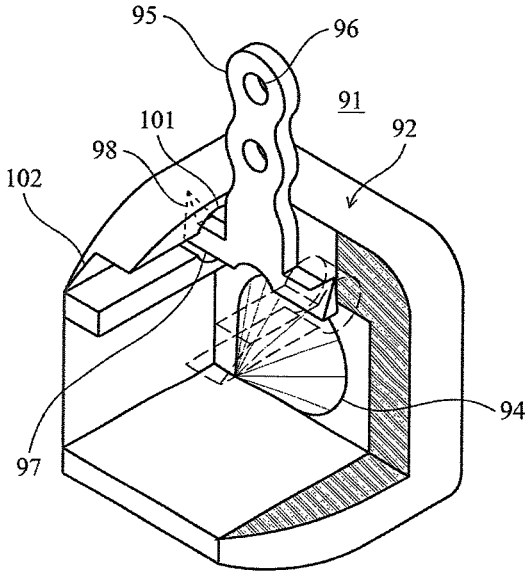
【Fig. 34】
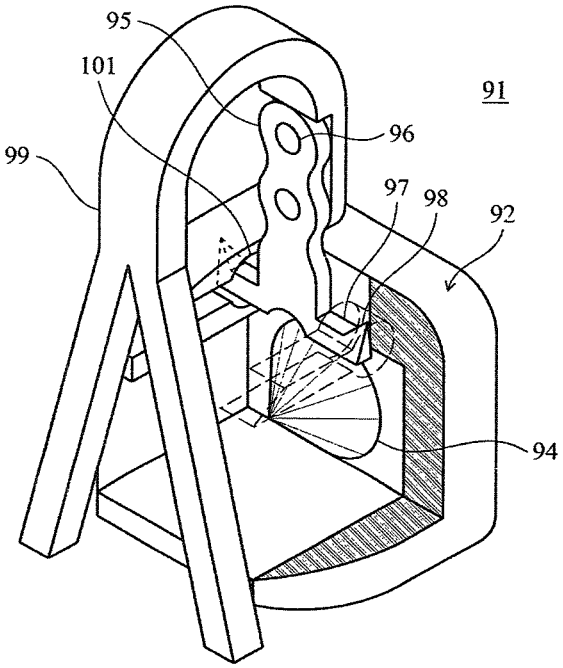

【Fig. 35】
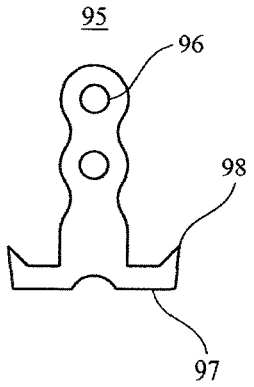
【Fig. 36】
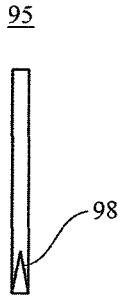
【Fig. 37】
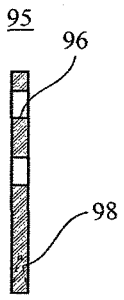

【Fig. 38】
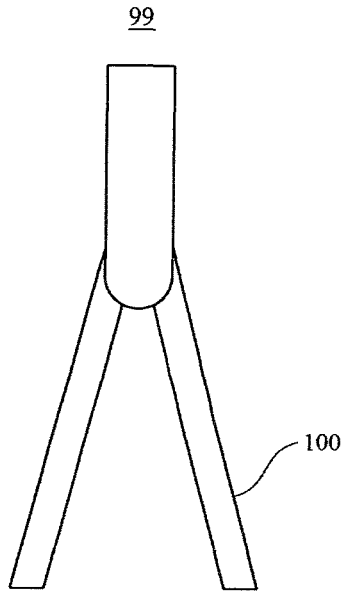
【Fig. 39】
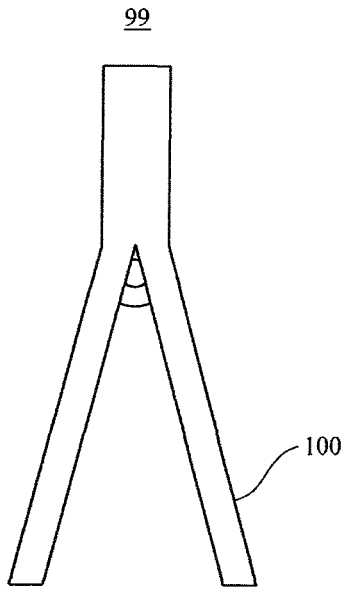

【Fig. 40】
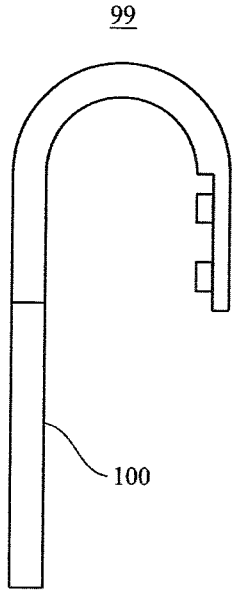
【Fig. 41】
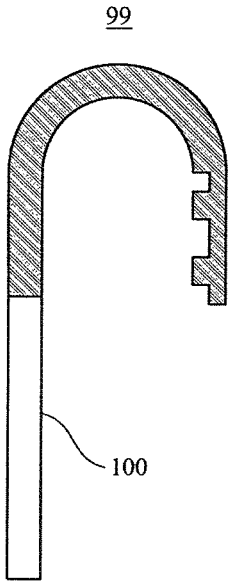

【Fig. 42】
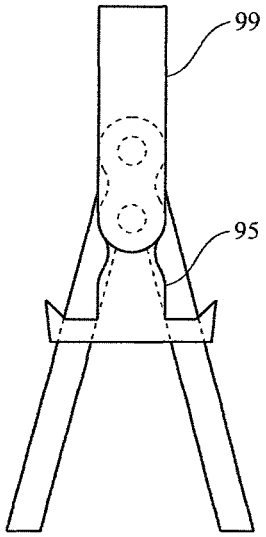
【Fig. 43】
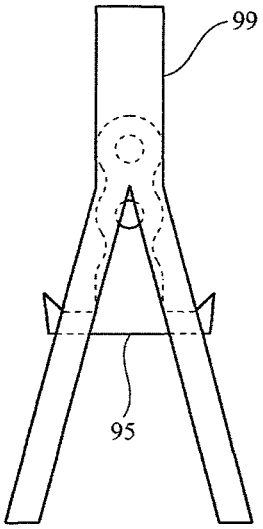

【Fig. 44】
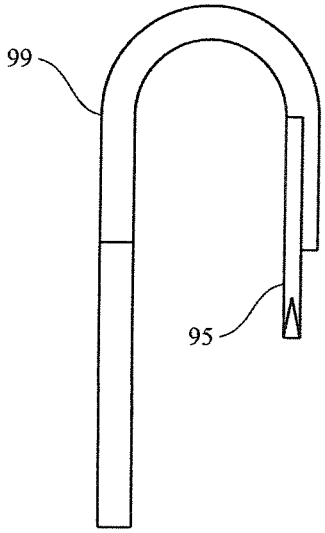
【Fig. 45】
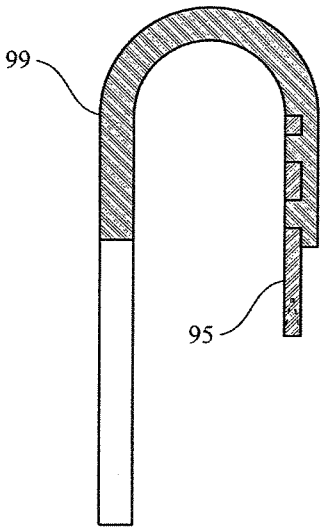

【Fig. 46】
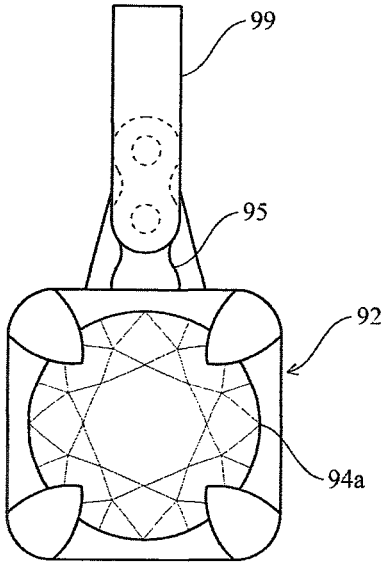
【Fig. 47】
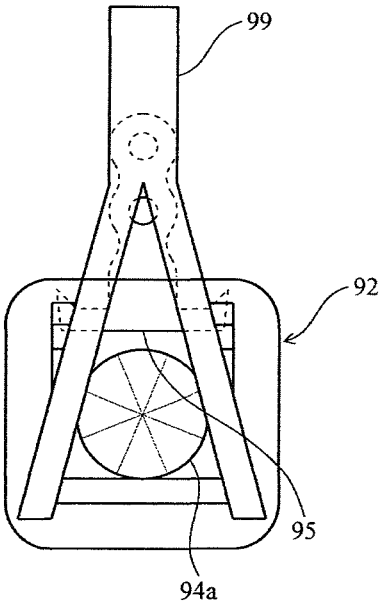

【Fig. 48】
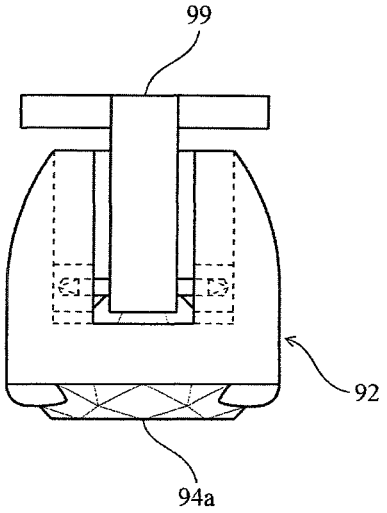
【Fig. 49】
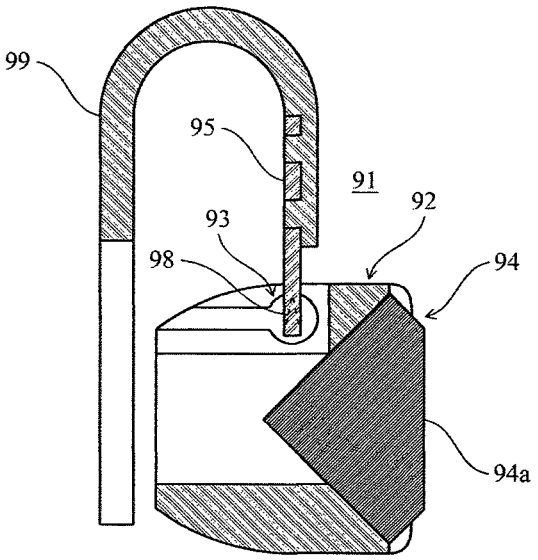

【Fig. 50】
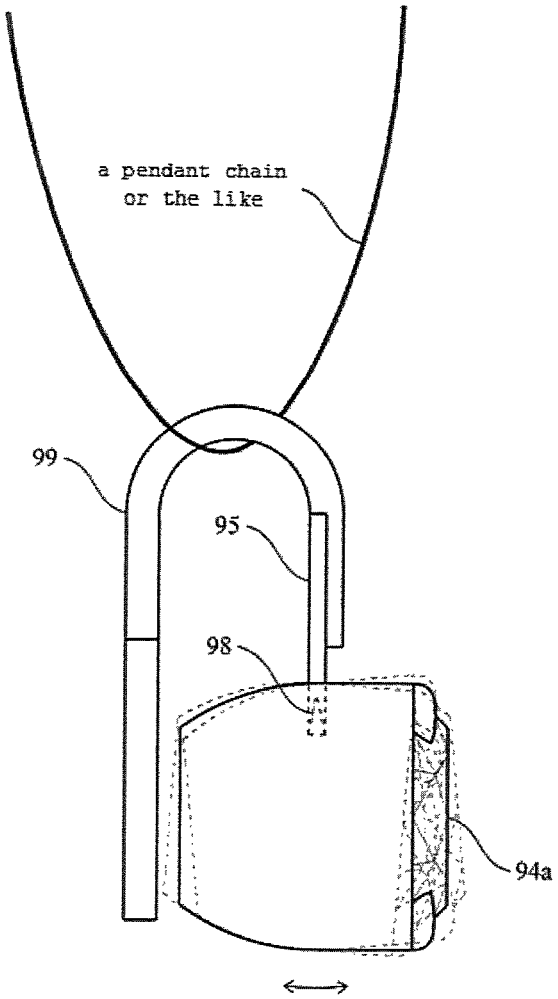

ACCESSORY

TECHNICAL FIELD

The present invention relates to an accessory, such as a pendant or broach, or a ring, bracelet or the like, which allows a gem to swing.

BACKGROUND ART

In recent years, various decorative items have been proposed having a construction such that, when a gem such as a diamond is worn, it is supported so that the table, in other words, top flat surface of the gem faces forward as it swings with the movement of the wearer.

Decorative items such as described in Japanese Unexamined Patent Application Publication No. 2013-226462 (see Patent Literature 1) are known as prior art, wherein an engagement section in which a frame member and a decorative object of a decorative item engage, has a first ring section provided on the left side, in the left-right direction that is orthogonal to the up-down direction with respect to the center of the decorative object, a second ring section provided on the right side of the center of the decorative object, a third ring section provided on the first ring section side of the frame member, which is connected to the first ring section, and a fourth ring section provided on the second ring section side of the frame member, which is connected to the second ring section.

CITATION LIST

Patent Literature

[Patent Literature 1] Japanese Unexamined Patent Application Publication No. 2013-226462

SUMMARY OF THE INVENTION

Problems to be Solved by the Invention

However, since the decorative object in the decorative item is held by the pair of connected rings, the movement is sometimes awkward and it is sometimes difficult to obtain a decorative item of uniform quality.

The present invention was devised with the aim of solving these inconveniences, and its object is to obtain an accessory of uniform quality with smooth movement of the decorative member.

Means for Solving the Problems

Specifically, the accessory of the invention comprises an accessory frame body having a pair of bearing recesses positioned at a prescribed spacing, and a decorative member held in a swingable state across the region between the bearing recesses of the accessory frame body, the decorative member extending in the horizontal direction after curving upward at a prescribed location, and having swinging arm sections protruding to both sides, with downwardly-pointing pivoting support shafts, formed at their free ends with only the pivoting support shafts of the swinging arm sections engaging with the bearing recesses formed in the accessory frame body, thereby attaching the decorative member to the accessory frame body in a freely swingable state.

Another feature of the accessory of the invention is that the center of gravity of the decorative member is located further downward than the tips of the pivoting support shafts.

More another feature of the accessory of the invention is that the pivoting support shafts have their tips slanting outward so that the top ends of the support shafts do not contact with the bearing recesses formed in the accessory frame body.

More another feature of the accessory of the invention is that the accessory frame body that holds the swinging arm sections has the bearing recesses has the bearing recesses for housing the swinging arm sections.

More another feature of the accessory of the invention is that the accessory frame body that holds the swinging arm sections has openings formed in the bearing recesses through which the swinging arm sections are inserted, and further comprising two outward rounded-shaped stoppers for sealing the openings and which are provided in a detachable state in a horizontal direction from outside and in a detachable state in a vertical direction from a beneath side to the openings when the state of the swinging arm sections are set therein.

More another feature of the accessory of the invention is that the accessory frame body that holds the swinging arm sections has holding cylinders mounted in the bearing recesses, in which openings are formed through which the swinging arm sections are inserted, the openings being sealed by cylindrical stoppers that are mounted on the holding cylinders when the swinging arm sections are set.

More another feature of the accessory of the invention is that it comprises an accessory frame body having a pair of bearing recesses positioned at a prescribed spacing from each other, a decorative member held on the accessory frame body, suspension members at the end of the decorative member, the suspension members including the swinging arm sections on which upwardly-pointing pivoting support shafts are formed in a protruding state on both sides thereof, the pivoting support shafts of the swinging arm sections engaging with the bearing recesses positioned in the accessory frame body, wherein the accessory frame body includes the decorative member attached to the suspension members in a freely swingable state.

More another feature of the accessory of the invention is that the suspension members comprise a spacer to hold the spacing from the body, formed turning downward after extending toward the rear from the back side, and have an accessory frame body comprising a decorative member, reliably attached with a freely swingable state on the suspension members.

Effect of the Invention

The accessory with the decorative member of the invention attached in a swingable state as described above, extends in the horizontal direction after curving upward at a prescribed location, and at the extended ends, has protruding on both sides of the decorative member, swinging arm sections formed with downwardly-pointing pivoting support shafts, the pivoting support shafts of the swinging arm sections engaging with the bearing recesses formed in the accessory frame body, thereby attaching the decorative member to the accessory frame body in a freely swingable state.

Such a state makes to form an accessory to be obtained of uniform quality with smooth movement of the decorative member.

BRIEF DESCRIPTION OF THE DRAWINGS

FIG. 1 is a simplified front view of a first example of the accessory of the invention.

FIG. 2 is a simplified side view of the same.

FIG. 3 is a simplified cross-sectional view of the same.

FIG. 4 is a partial cross-sectional perspective view of the accessory frame body and decorative member when disassembled.

FIG. 5 is a partial cross-sectional perspective view of the state of the decorative member attached to the accessory frame member.

FIG. 6 is a partial cross-sectional front view showing a modification of the first example of the accessory of the invention.

FIG. 7 is a simplified side view of a bearing recess of the same.

FIG. 8 is a simplified side view of a second example of the accessory of the invention.

FIG. 9 is a simplified cross-sectional view of the same.

FIG. 10 is a simplified side view showing a third example of the accessory of the invention, in a state with the decorative member about to be attached to the holding cylinder.

FIG. 11 is a simplified cross-sectional view of the same.

FIG. 12 is a simplified side view showing the state of the decorative member attached to the holding cylinder.

FIG. 13 is a simplified cross-sectional view of the same.

FIG. 14 is a simplified side view showing the closed state of the opening upon turning the cylindrical stopper on the holding cylinder.

FIG. 15 is a simplified cross-sectional view of the same.

FIG. 16 is a simplified perspective view of a fourth example of the accessory of the invention.

FIG. 17 is a simplified perspective view as seen from the back side of the same.

FIG. 18 is a simplified longitudinal sectional view of the same.

FIG. 19 is a partial cross-sectional rear view of the same.

FIG. 20 is a simplified cross-sectional view showing the same, cut in the horizontal direction.

FIG. 21 is a partial cross-sectional perspective view showing the state where the swinging arm sections protruding to both sides of the decorative member are about to be attached to the bearing recesses formed in the accessory frame body.

FIG. 22 is a partial cross-sectional perspective view showing the state where the swinging arm sections are fitted into the bearing recesses and are about to be rotated downward.

FIG. 23 is a partial cross-sectional perspective view showing the state where the cylindrical stopper is turned to close the opening.

FIG. 24 is a partial cross-sectional perspective view showing the state where attachment of the swinging arm sections protruding to both sides of the decorative member to the bearing recesses formed in the accessory frame body has been completed.

FIG. 25 is a simplified front view of a fifth example of the accessory of the invention.

FIG. 26 is a simplified rear view of the same.

FIG. 27 is a simplified plan view of the same.

FIG. 28 is a simplified longitudinal sectional view of the same.

FIG. 29 is a simplified perspective view of the same.

FIG. 30 is a partial cross-sectional perspective view of the same.

FIG. 31 is a partial cross-sectional perspective view showing the state where the swinging arm sections are about to be attached to the bearing recesses formed in the decorative member.

FIG. 32 is a partial cross-sectional perspective view showing the state where the swinging arm sections are fitted into the bearing recesses and are about to be rotated upward.

FIG. 33 is a partial cross-sectional perspective view showing the state where the swinging arm sections have been attached to the bearing recesses formed in the decorative member.

FIG. 34 is a partial cross-sectional perspective view of a modification of the fifth example of the accessory of the invention, showing the state where the swinging arm sections have behind them a spacer attached that maintains spacing with the body.

FIG. 35 is a simplified front view showing the swinging arm sections.

FIG. 36 is a simplified side view of the same.

FIG. 37 is a simplified longitudinal sectional view of the same.

FIG. 38 is a front view of the spacer.

FIG. 39 is a rear view of the spacer.

FIG. 40 is a side view of the spacer.

FIG. 41 is a longitudinal sectional view of the spacer.

FIG. 42 is a front view showing the state where the spacer has been fitted into the suspension member.

FIG. 43 is a rear view showing the state where the spacer has been fitted into the suspension member.

FIG. 44 is a side view showing the state where the spacer has been fitted into the suspension member.

FIG. 45 is a longitudinal sectional view showing the state where the spacer has been fitted into the suspension member.

FIG. 46 is a front view showing the state where the spacer-fitted suspension member has been attached to the accessory frame body.

FIG. 47 is a rear view showing the state where the spacer-fitted suspension member has been attached to the accessory frame body.

FIG. 48 is a side view showing the state where the spacer-fitted suspension member has been attached to the accessory frame body.

FIG. 49 is a longitudinal sectional view showing the state where the spacer-fitted suspension member has been attached to the accessory frame body.

FIG. 50 is a side view showing the state where a chain has been attached to the accessory.

BEST MODE FOR CARRYING OUT THE INVENTION

An embodiment of the accessory of the invention will now be explained using a pendant as an example of the accessory.

As shown in FIG. 1 to FIG. 5, the accessory 11 comprising the pendant top of this example comprises an accessory frame body 12 with a pair of bearing recesses situated at a prescribed spacing, and a decorative member 14 engaged with a gem 14*a* such as a diamond, for example, held in a swingable state across branched arm sections 13, 13 of the accessory frame body 12.

The decorative member 14 extends in the horizontal direction after curving upward at a prescribed location, and at the extended ends, swinging arm sections 15, on which downwardly-pointing pivoting support shafts 16 have been formed, protrude to both sides.

From the disassembled state shown in FIG. 4 to the fitted state shown in FIG. 5, the swinging arm sections 15 are oriented so that the pivoting support shafts 16 of the swinging arm sections 15 engage with the bearing recesses 21 formed in the accessory frame body 12, thereby holding the decorative member 14 in the accessory frame body 12 in a freely swingable state.

In the accessory 11 of this example, the center of gravity of the decorative member 14 is located further downward than the tips of the pivoting support shafts 16. Therefore, the gem 14*a* of the decorative member 14 swings in a stable state without spinning.

Also, the pivoting support shafts 16 have their tips slanting outward so that the top ends of the support shafts 16 do not contact with the inner walls of the bearing recesses 21 formed in the accessory frame body 12, as shown in FIG. 3 to FIG. 5.

Consequently, the swinging arm sections 15 supported by the pivoting support shafts 16 can swing without excessive force in the bearing recesses 21.

In the accessory 11 of this example, the accessory frame body 12 that holds the swinging arm sections 15 is continuously formed with the swinging arm sections 15 of the decorative member 14 housed inside the bearing recesses 21.

For this accessory 11, the following means may be employed to integrally form the accessory frame body 12 and the decorative member 14.

1) The branched arm sections 13, 13 of the accessory frame body 12 may spread outward in the directions of the arrows A1 in FIG. 3, and force applied for closing in the inward direction of the arrows A1 after the swinging arm sections 15 of the decorative member 14 have been housed in the bearing recesses 21.

2) Openings may be provided on at least one side of each of the bearing recesses 21, with outwardly round-shaped stoppers 21*a* being provided that are detachable in the horizontal direction, and the swinging arm sections 15 of the decorative member 14 can be fitted into the bearing recesses 21 when the outwardly round-shaped stoppers 21*a* have been removed in the outward direction of the arrow A2, after which the outwardly round-shaped stoppers 21*a* may be fitted in the inward direction of the arrow A2.

3) Openings may be provided on at least one side of each of the bearing recesses 21, with outwardly round-shaped stoppers 21*b* being provided that are detachable in the vertical direction, and the swinging arm sections 15 of the decorative member 14 can be fitted into the bearing recesses 21 when the outwardly round-shaped stoppers 21*b* have been removed in the downward direction of the arrow A3, after which the outwardly round-shaped stoppers 21*b* may be fitted in the upward direction of the arrow A3.

A modification of the first example of the accessory of the invention is illustrated in FIG. 6 and FIG. 7.

In this modified example as well, the accessory 11 comprises an accessory frame body 12 having a branched structure, and a decorative member 14 engaged with a gem 14*a* such as a diamond, for example, held in a swingable state across branched arm sections 13, 13 of the accessory frame body 12.

However, in this example, the bearing recesses 21 provided in the accessory frame body 12 each are provided with a first recess 21*c* having a circular cross-section at the top, and an arc-shaped second recess 21*d* at the bottom, that encloses the lower half of the first recess 21*a* that has a circular cross-section.

With this construction, it is possible to fit the pivoting support shaft 16 portions of the swinging arm sections 15 of the decorative member 14 into the first recesses 21*c* with circular cross-sections in the bearing recesses 21, and also the curved portions 15*a* of the swinging arm sections 15 in the arc-shaped second recesses 21*d*, thereby providing an accessory with an improved decorative property.

Next, a second example of the accessory of the invention is illustrated in FIG. 8 and FIG. 9.

In this example as well, the accessory 31 comprises an accessory frame body 32 having a branched structure, and decorative member 34 engaged with a gem 34*a* such as a diamond, for example, held in a swingable state across branched arm sections 33, 33 of the accessory frame body 32.

However, in this example, the accessory frame body 32 has a hollow structure, the bearing recesses 41 being formed in the accessory frame body 32 into prescribed shapes by press working or the like. Naturally, the pivoting support shafts 36 of the swinging arm sections 35 of the decorative member 34 are fitted into the bearing recesses 41.

By thus giving the accessory frame body 32 a hollow structure, it is possible to significantly reduce cost while also reducing the weight.

A third example of the accessory of the invention is illustrated in FIG. 10 to FIG. 15.

In this example as well, the accessory 51 comprises an accessory frame body 52 having a branched structure, and a decorative member 54 engaged with a gem 54*a* such as a diamond, for example, held in a swingable state across branched arm sections 53, 53 of the accessory frame body 52.

However, in this example, a holding cylinder 62 having an opening 63 formed through which the swinging arm sections 55 are inserted, is attached to the bearing recesses 61 of the accessory frame body 52. Numeral 64 is a cylindrical stopper having an opening 65 formed corresponding to the opening 63. The accessory of this example is fitted and used in the following process.

1) First, as shown in FIG. 10 and FIG. 11, the swinging arm sections 55 are inserted to the openings 63, 65 of the holding cylinders 62 and the cylindrical stopper 64.

2) Next, as shown in FIG. 12 and FIG. 13, the swinging arm sections 55 are set in the holding cylinders 62.

3) In this state, as shown in FIG. 14 and FIG. 15, turning the cylindrical stoppers 64 on the holding cylinders 62 causes the openings 63 of the holding cylinders 62 to shift away from the openings 65 of the cylindrical stoppers 64 and become closed off by the cylindrical stoppers 64.

By performing this procedure, it is possible to conveniently and reliably attach and lock the swinging arm sections 55 of the decorative member 54 onto the bearing recesses 61 of the accessory frame body 52.

FIG. 16 to FIG. 24 show a fourth example of the accessory of the invention.

As shown in FIG. 16 to FIG. 20, the accessory 71 comprising the pendant top of this example comprises an essentially ring-shaped accessory frame body 72 with a branched structure, and a decorative member 74 engaged with a gem 74*a* such as a diamond, for example, held in a swingable state across a ring-shaped branched arm sections 73 of the accessory frame body 72.

The decorative member 74 extends in the horizontal direction after curving upward at a prescribed location, and at the extended ends, swinging arm sections 75 on which downwardly-pointing pivoting support shafts 76 have been formed protrude to both sides.

However, in this example, holding cylinders 82 having openings 83 formed through which the swinging arm sections 75 are inserted, are attached as the bearing recesses 81 of the accessory frame body 72. Numeral 84 is a cylindrical stopper having an opening 85 formed corresponding to the opening 83. The accessory of this example is fitted and used in the following process.

1) First, as shown in FIG. 21, the swinging arm sections 75 are inserted to the openings 83, 85 of the holding cylinders 82 and the cylindrical stopper 84.

2) Next, the swinging arm sections 75 are set in the holding cylinders 82 as shown in FIG. 22, and the pivoting support shafts 76 are turned downward either by their own weight or by hand, as shown in FIG. 23.

3) In this state, as shown in FIG. 24, turning the cylindrical stoppers 84 on the holding cylinders 82 causes the openings 83 of the holding cylinders 82 to shift away from the openings 85 of the cylindrical stoppers 84 and become closed off by the cylindrical stoppers 84.

By performing this procedure, it is possible to conveniently and reliably attach and lock the swinging arm sections 75 of the decorative member 74 onto the bearing recesses 81 of the accessory frame body 72. Naturally, an accessory with a more intricate decorative property may be provided so that the swinging arm sections 75 or the like are housed in the accessory frame body 72 and are not visible from the exterior.

Additionally in FIG. 17 to FIG. 24, numeral 77 is a tubular balance weight for adjustment of the center of gravity of the gem 74*a* engaged with the decorative member 74, such that changing the length of the balance weight 77 allows the center of gravity to be adjusted.

FIG. 25 to FIG. 33 show a fifth example of the accessory of the invention.

As shown in FIG. 25 to FIG. 30, the accessory 91 comprising the pendant top of this example comprises an accessory frame body 92 with a pair of bearing recesses 93, 93 situated at a prescribed spacing, and a decorative member 94 engaged with a gem 94*a* such as a diamond, for example, held in an integral state in the accessory frame body 92.

The accessory frame body 92 comprising the decorative member 94 is suspended and swings on a suspension member 95 which comprises, at the top end, a suspension hole 96 through which a pendant chain (not shown) or the like is inserted, and which has swinging arm sections 97 of protruding state at the extended both sides with pivoting support shafts 98 formed pointing upward.

However, in this example, there are provided holders 101 each with a cylindrical cross-section, having guide grooves 102 through which the swinging arm sections 97 are inserted, thus serving as the bearing recesses 93, 93 of the accessory frame body 92. The accessory of this example is fitted and used in the following process.

1) First, as shown in FIG. 31, the swinging arm sections 97 of the suspension member 95 are fitted through the guide grooves 102 of the holders 101.

2) Next, the swinging arm sections 97 are set in the holders 101 as shown in FIG. 32, and the pivoting support shafts 98 are turned upward, as shown in FIG. 33.

By performing this procedure, it is possible to conveniently and reliably attach and lock the swinging arm sections 97 of the suspension member 95 onto the bearing recesses 93, 93 of the accessory frame body 92. Naturally, an accessory with a more intricate decorative property may be provided so that the swinging arm sections 97 or the like are housed in the accessory frame body 92 and are not visible from the exterior.

FIG. 34 to FIG. 50 show a modification of the fifth example of the accessory of the invention.

As shown in FIG. 34, the accessory 91 comprising the pendant top of this modified example comprises an accessory frame body 92 with a pair of bearing recesses 93, 93 situated at a prescribed spacing, and a decorative member 94 engaged with a gem 94*a* such as a diamond, for example, held in an integral state in the accessory frame body 92.

The accessory frame body 92 comprising the decorative member 94 is suspended and swings on the suspension member 95.

As shown in FIG. 35 to FIG. 37, the suspension member 95 comprises, at the top end, a suspension hole 96 through which a ring attached to a pendant chain (not shown) is inserted, and which has swinging arm sections 97 of protruding state at the extended both sides with pivoting support shafts 98 formed pointing upward.

In FIG. 38 to FIG. 41, numeral 99 is a spacer that serves to maintain a spacing with the body, being formed turning downward after extending toward the rear from above the suspension member 95. The spacer 99 serves to allow the accessory frame body 92 comprising the decorative member 94 to be reliably attached in a freely swingable state, without the accessory frame body 92 contacting the body and having its movement blocked, when the accessory frame body 92 comprising the decorative member 94 is suspended on the suspension member 95.

The spacer 99 has a U-shape, and one end thereof is connected and fixed to the suspension hole 96 provided at the top of the suspension member 95, by means such as a swage, and it turns downward from the rear forming a bifurcated stabilizing strip 100.

FIG. 42 to FIG. 45 show the state in which the suspension member 95 and the spacer 99 have been fitted together.

FIG. 46 to FIG. 50 show the state where the suspension member 95 with the spacer 99 fitted has been attached to the accessory frame body 92.

With this construction, the pivoting support shafts 98 of the swinging arm sections 97 of the suspension member 95 may be held in the bearing recesses 93, 93 of the accessory frame body 92 without excessive force, and if a chain is attached as shown in FIG. 50, the gem 94*a* such as a diamond will be oriented with its table, in other words, top flat surface facing the front when worn, while the gem 94*a* can be supported in a swinging state in response to movement of the wearer. Naturally, an accessory with a more intricate decorative property may be provided so that the swinging arm sections 97 or the like are housed in the accessory frame body 92 and are not visible from the exterior.

When the suspension member 95 is attached, the swinging arm sections 97 of the suspension member 95 are inserted in the guide grooves 102 of the holders 101 through the guide grooves 102 of the holders 101, and then the swinging arm sections 97 are set in the holders 101, upon which the pivoting support shafts 98 can be set and locked by simply being pointed upward.

The widths of the open sections may be narrowed by swages or the like and closed with closing seals or the like, as a means of such locking, thereby helping to prevent the swinging arm sections 97 from falling out from the guide grooves 102.

INDUSTRIAL APPLICABILITY

In the examples described above, a pendant was used for illustration of the accessory of the invention, but the invention is not limited to application for a pendant and may instead be applied for a bracelet or broach, earring or other accessory.

Moreover, although a diamond is shown as the gem in the examples, there is naturally no restriction to a diamond.

DESCRIPTION OF SYMBOLS

11: Accessory
12: Accessory frame body
13, 13: Branched arm sections
14: Decorative member
14*a*: Gem
15: Swinging arm section
16: Pivoting support shaft
21: Bearing recess
21*a*: outwardly round-shaped stopper
21*b*: outwardly round-shaped stopper
21*c*: First recess
21*d*: Second recess
31: Accessory
32: Accessory frame body
33, 33: Branched arm sections
34: Decorative member
34*a*: Gem
35: Swinging arm section
36: Pivoting support shaft
41: Bearing recesses
51: Accessory
52: Accessory frame body
53, 53: Branched arm sections
54: Decorative member
54*a*: Gem
61: Bearing recess
62: Holding cylinder
63: Opening
64: Cylindrical stopper
65: Opening
71: Accessory
72: Accessory frame body
73: Ring-shaped branched arm section
74: Decorative member
74*a*: Gem
75: Swing arm
76: Pivoting support shaft
77: Balance weight
81: Bearing recess
82: Holding cylinder
83: Opening
84: Cylindrical stopper
85: Opening
91: Accessory
92: Accessory frame body
93, 93: Bearing recesses
94: Decorative member
94*a*: Gem
95: Suspension member
96: Suspension hole
97: Swinging arm section
98: Pivoting support shaft
99: Spacer
100: Stabilizing strip
101: Holding cylinder
102: Guide grooves

What is claimed is:

1. An accessory comprising:

an accessory frame body having a pair of bearing recesses positioned at a prescribed spacing from each other, and a decorative member held in a swingable state across a region between the bearing recesses of the accessory frame body, the decorative member extending in the horizontal direction after curving upward at a prescribed location, and having swinging arm sections protruding from opposite sides thereof, with downwardly-pointing pivoting support shafts formed at free ends of the swinging arm sections, only the pivoting support shafts of the swinging arm sections engaging with the bearing recesses formed in the accessory frame body hold the decorative member to the accessory frame body in a freely swingable state, wherein the pivoting support shafts have tips slanting outward so that top ends of the support shafts do not contact with the bearing recesses formed in the accessory frame body.

2. The accessory according to claim 1, wherein the decorative member has a center of gravity located further downward than tips of the pivoting support shafts.

3. The accessory according to claim 1, wherein the accessory frame body that holds the swinging arm sections has the bearing recesses formed therewith for housing the swinging arm sections.

4. An accessory comprising:

an accessory frame body having a pair of bearing recesses positioned at a prescribed spacing from each other, and a decorative member held in a swingable state across a region between the bearing recesses of the accessory frame body, the decorative member extending in the horizontal direction after curving upward at a prescribed location, and having swinging arm sections protruding from opposite sides thereof, with downwardly-pointing pivoting support shafts formed at free ends of the swinging arm sections, only the pivoting support shafts of the swinging arm sections engaging with the bearing recesses formed in the accessory frame body hold the decorative member to the accessory frame body in a freely swingable state, wherein the accessory frame body that holds the swinging arm sections has openings formed in the bearing recesses through which the swinging arm sections are inserted, and further comprising first stoppers for sealing the openings and which are detachably mountable in a horizontal direction from an exterior of the accessory frame body and second stoppers for sealing the openings and which are detachably mountable in a vertical direction below the openings from the exterior of the accessory frame body when the state of the swinging arm sections are set therein.

5. The accessory according to claim 4, wherein the decorative member has a center of gravity located further downward than tips of the pivoting support shafts.

6. The accessory according to claim 4, wherein the accessory frame body that holds the swinging arm sections has the bearing recesses formed therewith for housing the swinging arm sections.

7. An accessory comprising:

an accessory frame body having a pair of bearing recesses positioned at a prescribed spacing from each other, and a decorative member held in a swingable state across a region between the bearing recesses of the accessory frame body, the decorative member extending in the horizontal direction after curving upward at a prescribed location, and having swinging arm sections protruding from opposite sides thereof, with downwardly-pointing pivoting support shafts formed at free ends of the swinging arm sections, only the pivoting support shafts of the swinging arm sections engaging with the bearing recesses formed in the accessory frame body hold the decorative member to the accessory frame body in a freely swingable state, wherein the accessory frame body that holds the swinging arm sections has holding cylinders mounted in the bearing recesses, in which openings are formed through which the swinging arm sections are inserted, and further comprising cylindrical stoppers for sealing the openings and which are mounted on the holding cylinders when the swinging arm sections are set therein.

8. The accessory according to claim 7, wherein the decorative member has a center of gravity located further downward than tips of the pivoting support shafts.

9. The accessory according to claim 7, wherein the accessory frame body that holds the swinging arm sections has the bearing recesses formed therewith for housing the swinging arm sections.

* * * * *